United States Patent [19]

Arkhipov et al.

[11] Patent Number: 4,795,311

[45] Date of Patent: Jan. 3, 1989

[54] CENTRIFUGAL COMPRESSOR IMPELLER

[75] Inventors: Vladimir V. Arkhipov; Gennady F. Velikanov; Yakov S. Levin; Vadim S. Magdychansky; Gennady I. Petrov; Gilya A. Raer; Kir B. Sarantsev, all of Leningrad, U.S.S.R.

[73] Assignee: Proizvodstvennoe Obiedinenie "Nevsky Zavod" Imeni V.I. Lenina, Leningrad, U.S.S.R.

[21] Appl. No.: 134,787

[22] PCT Filed: Jun. 20, 1986

[86] PCT No.: PCT/SU86/00060

§ 371 Date: Sep. 1, 1987

§ 102(e) Date: Sep. 1, 1987

[87] PCT Pub. No.: WO87/04500

PCT Pub. Date: Jul. 30, 1987

[30] Foreign Application Priority Data

Jan. 17, 1986 [SU] U.S.S.R. ..... 4001923

[51] Int. Cl.[4] ..... F04D 29/22

[52] U.S. Cl. ..... 416/186 R; 416/223 B

[58] Field of Search ..... 416/186 R, 199, 186 A, 416/184, 188, 187, 223 B

[56] References Cited

U.S. PATENT DOCUMENTS

| | | | |
|---|---|---|---|
| 1,902,406 | 3/1933 | Inokuty et al. | 416/184 |
| 1,983,201 | 12/1934 | Van Rijswijk | 416/186 R |
| 2,285,266 | 6/1942 | Füllemann | 416/186 R X |
| 2,392,858 | 1/1946 | McMahan | 416/186 R |
| 2,613,609 | 10/1952 | Büchi | 416/186 R |
| 2,784,936 | 3/1957 | Schmidt | 416/186 R |
| 4,720,242 | 1/1988 | Lovisetto | 416/186 A |

FOREIGN PATENT DOCUMENTS

| | | | |
|---|---|---|---|
| 462853 | 7/1928 | Fed. Rep. of Germany | 416/186 R |
| 906975 | 3/1954 | Fed. Rep. of Germany | 416/186 R |
| 937120 | 12/1955 | Fed. Rep. of Germany | 416/186 R |
| 1503584 | 1/1970 | Fed. Rep. of Germany | 416/186 R |
| 2502988 | 7/1976 | Fed. Rep. of Germany | 416/186 R |
| 2720100 | 12/1977 | Fed. Rep. of Germany | 416/186 R |
| 385070 | 8/1973 | U.S.S.R. | 416/186 R |
| 994806 | 2/1983 | U.S.S.R. | 416/184 |

OTHER PUBLICATIONS

V. F. Ris. Centrifugal Compressor Machines, 1981, Mashinostroenie Publishers, Leningrad, pp. 35, 103.

A. D. Bruk Smoke Exhausters of Gas Purification Facilities, 1984, Machinostroenie Publishers, Moscow, p. 120.

*Primary Examiner*—Everette A. Powell, Jr.

*Attorney, Agent, or Firm*—Burgess, Ryan & Wayne

[57] ABSTRACT

An impeller, comprising a main disc (1), blades (2) and a covering disc (3) which consists of interconnected web (4) and ring (5). The joint of the web (4) and ring (5) is detachable to form mated surface (6 and 7) in the place of the joint and has on the surface (7) of the ring (5) an annular shoulder (8) and on the surface (6) of the web (4) an annular groove (9) accomodating the shoulder (8). The internal diameter Do of the web (4) is less than the diameter (D) of the ring (5) along their mated surfaces (6 and 7) by 1 to $1.5\times10^{-3}$ Do.

1 Claim, 2 Drawing Sheets

CENTRIFUGAL COMPRESSOR IMPELLER

TECHNICAL FIELD

The present invention relates to compressor building and, more particularly, to centrifugal compressor impellers.

BACKGROUND OF THE INVENTION

Known in the art is the impeller of a centrifugal compressor comprising the main disc, blades and a covering disc which consists of a web to effect gas flow in the impeller and a ring to accomodate seals (V.F. Ris. Centrifugal Compressor Machines, 1981, Mashinostroenie Publishers, Leningrad, pp. 35, 103).

The covering disc is made solid from one forging. The impellers with such covering discs feature the possibility of operation at high circumferential velocities (from 120 to 300 m/s).

However, the making of covering discs solid from one forging calls for substantial consumption of metal (metal utilization factor is 15%) and great labour intensity (85% of metal turn into chips).

Besides, high circumferential velocities give rise to flexural strain of the ring and the web, as well as radial strain of the ring. These strains bring about radial movement of the ring which calls for larger clearances between the ring and the seals mounted in the compressor body. The larger the clearances, the greater are gas leakages and the lower is the compressor efficiency.

There is known in the art a centrifugal compressor impeller, comprising the main disc, blades and a covering disc made up from the web for effecting the flow of gas in the impeller and the ring for accomodating the seals, both the web and ring being interconnected. (cf. A. D. Bruk. Smoke Exhausters of Gas Purification Facilities. 1984, Machinostroenie Publishers, Moscow, p. 120).

The ring is connected to the web either through welding or rivetting. The impeller in which the covering disc is made composite with such a connection of the web to the ring features lesser labour and metal intensity compared with that in which the disc is solid, but higher stress in the web-ring joint making it impossible to use such impellers in case circumferential velocities are greater than 120 m/s.

SUMMARY OF THE INVENTION

It is the main object of the present invention to develop an impeller wherein the web is linked with the ring so as to diminish the stress in the place of connection and thereby make it possible to use these impellers for circumferential velocities of over 120 m/s.

The object set forth is accomplished in the centrifugal compressor impeller, comprising the main disc, blades and the covering disc which consists of the interconnected web to effect gas flow in the impeller and the ring to accomodate seals, in which, according to the invention, the web-ring joint is detachable to form mated surfaces in the web and ring and has an annular shoulder on the mated surface of the ring as viewed from the blades, said shoulder being accomodated in the annular groove made on the mated surface of the web whose internal diameter is less than the ring diameter along the mated surfaces by 1 to $1.5\times10^{-3}$ Do, where Do is the web internal diameter.

It is only the centrifugal force from the inherent mass of the covering disc web and the part of the blades' mass that affects the web. The force of interaction between the web and the ring is actually absent because no interaction is observed between the ring and the web with the chosen difference of diameters (tension value), these elements merely contact each other. The lack of a bending moment rules out the bending of the web thereby ensuring its steady loading and, as a result, the lowering of the level of circumferential stresses and a complete elimination of radial stresses. Besides, the ring of the covering disc is acted upon only by the centrifugal forces of the inherent mass of the ring, therefore, stresses therein and consequently, radial motions are negligible.

The absence of the forces of interaction between the web and the ring, and a low stress level in the place of connection of the web with the ring make it possible to use such a construction of the impellers with the covering discs operating at circumferential velocities substantially surpassing a circumferential velocity of 120 m/s (as high as 300 m/s).

The availability of a shoulder in the ring as viewed from the blades and the arrangement thereof in the annular groove of the web prevent the ring, as a rigid body, from moving axially and radially with respect to the web. The axial motion to one side is ruled out by the end face surfaces of the shoulder and the groove, and to the other side, by the blades. Relative radial movements of the ring (caused by its residual unbalance) are excluded by the frictional force in the place where the shoulder makes contact with the blades. The said frictional force arises from axial loads transmitted from the web via the end face surface of the shoulder and groove to the blades. These loads rule out only relative motions of the ring as a rigid body.

Experimental studies have shown that the optimal values of tension (the difference between the mated diameters of the ring and the web) lie within the range 1 to $1.5\times10^{31\,3}$ Do, where Do is the web internal diameter.

The lower limit of the tension value $1\times10^{-3}$ Do is stipulated by the possibility of mechanical machining of the covering disc when the latter is fabricated. With tension values below $1\times10^{-3}$ Do, it is impossible to mechanically machine the covering disc using any method of securing same.

With the tension values in the ring-web joint greater than $1.5\times10^{-3}$ Do, as the compressor operates, there is observed the impact of the web on the ring which brings about a higher stress level of the joint, a rise in the ring strain and makes it necessary to increase the clearances in the seals at higher circumferential velocities which, in turn, leads to greater leakages and a decline in the compressor efficiency.

BRIEF DESCRIPTION OF THE DRAWING

The present invention will be more apparent upon considering a detailed description of an exemplary embodiment thereof with references to the accompanying drawing.

BEST MODE FOR CARRYING OUT THE INVENTION

Figure 1:
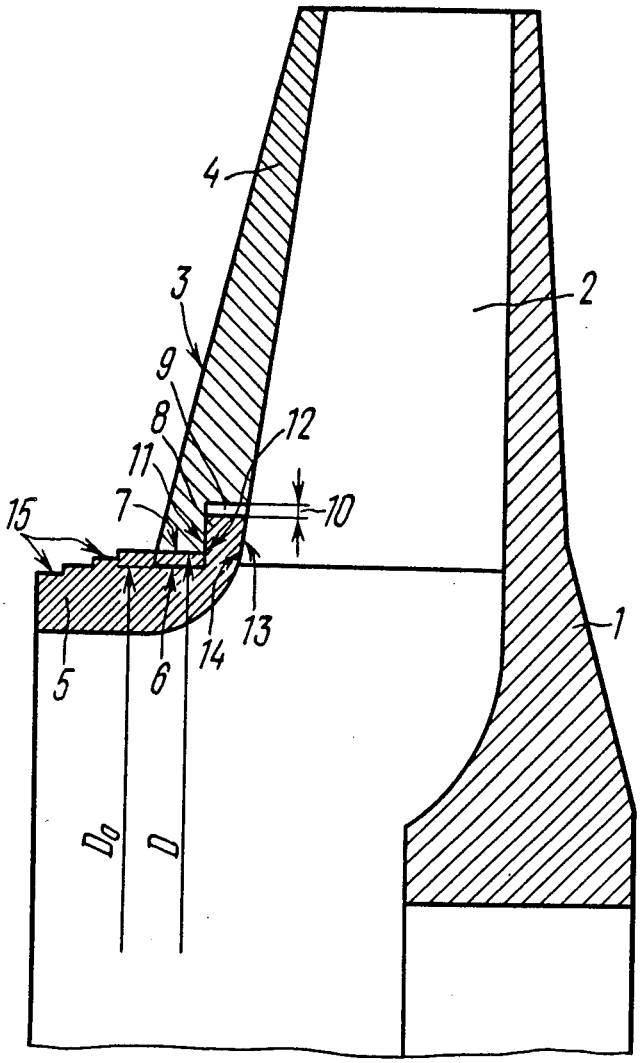
FIG. 1 shows a longitudinal section of the general view of part of the centrifugal compressor impeller, according to the invention.
Figure 2C:
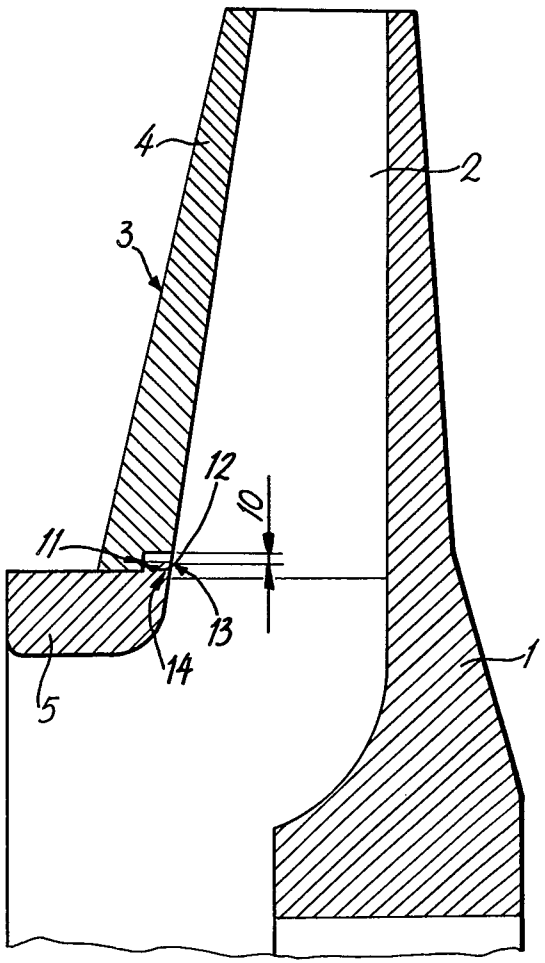
FIG. 2*c* is a longitudinal sectional view of the impeller of FIG. 1 with the claimed covering disc.
Figure 2B:
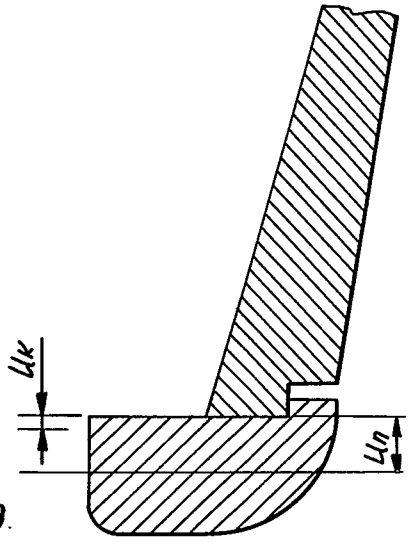
FIG. 2*b* is a longitudinal sectional view of the covering disc, as assembled, at the operating rotational speed.
Figure 2A:
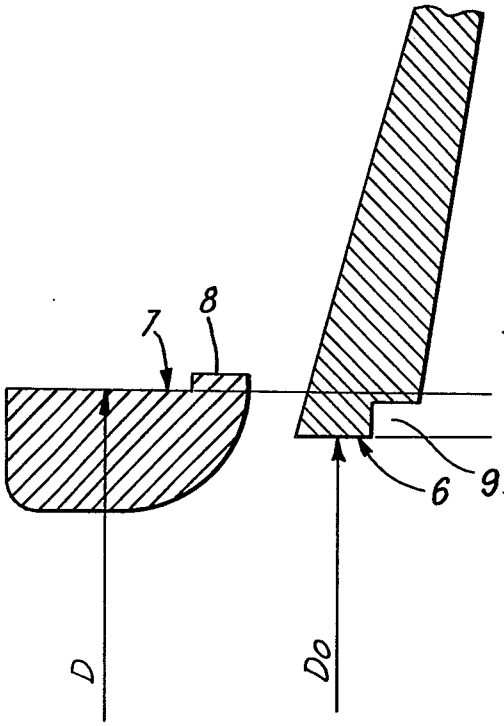
FIG. 2*a* is a exploded longitudinal sectional view of the covering disc of the impeller of FIG. 1, with the ring and web before they are joined.

The herein-disclosed centrigugal compressor impeller shown in FIG. 1 comprises a main disc 1 and blades 2 made integral with the disc 1 or welded (rivetted) thereto.

Rigidly connected (welded or rivetted) to the blades 2 is a covering disc 3 consisting of interconnected web 4 to effect gas flow in the impeller and a ring 5 to accomodate seals (not shown in the Figure) precluding gas leakage.

The joint of the web 4 and the ring 5 is detachable to form mated surfaces 6 and 7 of the web 4 and the ring 5, respectively.

The internal diameter Do of the web 4 is less than diameter D of the ring 5 along their mated surfaces 6 and 7.

The difference between the diameters Do and D lies within the range 1 to $1.5\times10^{31\ 3}$ Do, which during the impeller operation precludes the interaction of the web 4 with the ring 5, drastically diminishes the stress level of the joint of the mated surfaces 6 and 7 and helps use the structure of the impeller for operation with circumferential velocities upwards of 120 m/s (as high as 300 m/s).

An annular shoulder 8 is provided on the mated surface 7 of the ring 5 as viewed from the blades 2. The annular shoulder 8 is accomodated in an annular groove 9 on the mated surface 6 of the web 4 in the covering disc 3.

There is a clearance 10 between the shoulder 8 and the groove 9.

The arrangement of the shoulder 8 in the annular groove 9 of the web 4 prevents the ring 5 from moving axially and radially.

End face surfaces 11 and 12 of the shoulder 8 and the groove 9, respectively, and the end face surfaces 13 and 14 of the shoulder 8 and the blades 2, respectively, rule out axial motion of the ring 5.

On the external surface of the ring 5 provision is made for several recesses 15 serving to accomodate the seals (not shown in the Figure).

The centrifugal compressor impeller operates as follows.

As the centrifugal compressor impeller rotates, centrifugal forces act upon its elements. Because the blades 2 are rigidly connected to the disc 1 and the web 4 of the covering disc 3, they are acted upon by centrifugal forces from the inherent mass and part of the mass of the blades 2. What is actually absent is the force of interaction between the web 4 and the ring 5 since the difference between the diameters Do and D of the mated surfaces 6 and 7 of the web 4 and the ring 5 is chosen in such a way that when the impeller operates, the interaction of the web 4 with the ring 5 is not observed, these elements only touch each other. The absence of interaction between the ring 5 and the web 4 entails the absence of bending moment to rule out the bending of the web 4.

The lack of bending of the web 4 ensures its uniform loading, a decline in the level of circumferential stresses and complete elimination of radial stresses.

Because there is actually no interaction of the ring 5 with the web 4, it is only centrifugal forces of the inherent mass of the ring 5 that act upon the ring 5 of the covering disc 3 which are insignificant due to a small circumferential velocity of the ring and its small mass (compared with the impeller circumferential velocity and the mass of the web 4 and part of the mass of the blades 2).

For this reason, the stresses in the ring 5 and, consequently, the radial movement of the ring 5 are negligible.

Thus, a decline in the level of stresses 8 in the web 4 and the lack of interaction between the ring 5 and the web 4 make it possible to operate the disclosed structure of the impeller with circumferential velocities upwards of 120 m/s (as high as 300 m/s), and a small value of radial movements of the ring 5 helps diminish the clearances in the seals, thereby leading to a decrease in leakages and an increase in the compressor efficiency.

Relative radial movements of the ring 5 (caused by its residual unbalance) are ruled out by frictional force in the place where the shoulder 8 makes contact with the blades 2. This frictional forces arises from axial loads transmitted from the web 4 via the end face surfaces 11 and 13 of the shoulder 8 and the end face surface 12 of the groove 9 to the blades 2.

The shoulder 8 also precludes axial motions of the ring 5 which are ruled out by the end face surfaces 11, 12, 13 and 14 of the shoulder 8, groove 9 and blades 2.

The technico-economic effect from utilizing the disclosed invention resides in the following:

- stress level is decreased in the place where thee web makes contact with the ring which helps to operate the covering discs of the disclosed structure at circumferential velocities upwards of 120 m/s (as high as 300 m/s);
- drastic decline in stress level and radial motions of the ring helps use the seals with minimal clearances—this factor increases the compressor efficiency (by 0.5%);
- in case of compressors operating at circumferential velocities as high as 300 m/s it is possible to fabricate the web of covering discs from a sheet through a stamping method and the ring—from a low-alloyed steel drum forging—this markedly diminishes labour and metal intensity of fabrication;
- there appears the possibility of fabricating the webs of covering discs with different external diameters and input diameters by using one die.

Industrial Applicability

The invention can be most advantageously utilized in closed-type centrifugal impellers.

Besides, the invention can be used in low-head impellers of centrifugal compressors (fans).

We claim:

1. A centrifugal compressor impeller, comprising a main disc, blades and a covering disc rigidly connected to one another, said covering disc including an interconected web to effect gas flow in the impeller and a ring to accommodate seals, characterized in that:

- the joint between the web and ring is detachable to form mated surfaces in the web and ring, respectively,
- an annular shoulder is formed on the mated surface of the ring as viewed from the blades,
- an annular groove is provided on the mated surface of the web and receives the annular shoulder, and
- the internal diameter (Do) of the web along its mated surface is less than the diameter of the ring along its mated surface by an amount in the range of 1 to $1.5\times10^{-3}$ Do.

* * * * *